US006932707B2

(12) United States Patent
Duhamel

(10) Patent No.: US 6,932,707 B2
(45) Date of Patent: Aug. 23, 2005

(54) METHOD OF CHOOSING AND DISTRIBUTING ENHANCED ODDS

(75) Inventor: Gérald Duhamel, Drummondville (CA)

(73) Assignee: Labtronix Concept Inc., Drummondville (CA)

( * ) Notice: Subject to any disclaimer, the term of this patent is extended or adjusted under 35 U.S.C. 154(b) by 58 days.

(21) Appl. No.: 10/203,649

(22) PCT Filed: Feb. 23, 2001

(86) PCT No.: PCT/CA01/00222

§ 371 (c)(1),
(2), (4) Date: Nov. 18, 2002

(87) PCT Pub. No.: WO01/63573

PCT Pub. Date: Aug. 30, 2001

(65) Prior Publication Data

US 2003/0153384 A1 Aug. 14, 2003

Related U.S. Application Data

(60) Provisional application No. 60/184,648, filed on Feb. 24, 2000.

(51) Int. Cl.[7] ..... A63F 9/24
(52) U.S. Cl. ..... 463/42; 463/25
(58) Field of Search ..... 463/16, 22, 25–28, 463/30, 31, 40, 41, 42, 43

(56) References Cited

U.S. PATENT DOCUMENTS 5,639,088 A 6/1997 Martin
5,655,961 A * 8/1997 Acres et al. ..... 463/27
5,766,076 A * 6/1998 Pease et al. ..... 463/27
6,110,043 A * 8/2000 Olsen ..... 463/27
6,217,448 B1 * 4/2001 Olsen ..... 463/25
6,364,765 B1 * 4/2002 Walker et al. ..... 463/16

FOREIGN PATENT DOCUMENTS

| | | |
|---|---|---|
| DE | 197 53 285 | 7/1999 |
| DE | 198 05 652 | 8/1999 |
| WO | WO 00 06267 | 2/2000 |

* cited by examiner

*Primary Examiner*—Kim Nguyen
(74) *Attorney, Agent, or Firm*—Ogilvy Renault LLP

(57) ABSTRACT

The method of choosing and distributing enhanced odds includes 1) linking numerous electronic gaming devices, such as electronic Poker machines, on a local network, 2) gathering in a progressive amount a percentage of all the bets placed on those devices such as for progressive jackpots, 3) using a process based on a combination of randomness and criteria to distribute for at least one game to one randomly selected device, a set of enhanced odds and 4) using the progressive amount gathered to pay prizes awarded with the set of enhanced odds. In a local network of electronic Poker machines (2), five percent (5%) of the bets are gathered by the network. When a predetermined amount is gathered, one electronic Poker machine randomly selected, presents to a player one game with a set of enhanced odds. When a win occurs corresponding to one of the four (4) highest hands, the prize is paid in regards to the enhanced odds.

11 Claims, 8 Drawing Sheets

METHOD OF CHOOSING AND DISTRIBUTING ENHANCED ODDS

This application claims the benefit of Provisional Application No. 60/184,648, filed Feb. 24, 2000.

FIELD OF THE INVENTION

The present invention relates to a method offering more interesting casino type games to players by distributing them enhanced odds. This method is particularly applied to in wagering games played on electronic gaming devices, such as electronic Poker machines.

BACKGROUND OF THE INVENTION

There are many kinds of video lotteries in commercial use. Managers choose to operate a particular kind of games according to players' preferences and to the current legislation. The kinds of games growing in popularity since the last decades are the ones played on electronic gaming devices comprising a video display. One example is Poker games played on electronic Poker machines.

One particular method used by gaming area managers to attract players consists to offering big prizes also known as jackpots. This method consists generally to award the progressive jackpot when a player yields a particularly rare winning combination. To increase faster the value of the progressive jackpot, a common technique is to link electronic gaming devices offering the same game on a network. Therefore, the value of the progressive jackpot grows in regards to the number of plays in the game on all the gaming devices of the network. Then, the jackpot is awarded to the first electronic gaming device of the network yielding the winning combination.

With this method, gaming area managers offer jackpots that can increase to very big values. Nevertheless, to obtain very big amounts, the winning combination must be very rare. Consequently, it is very rare for players to see someone win the jackpot. Furthermore, to increase the jackpot even faster, the network frequently links devices from different locations. Therefore, the jackpot is sometimes awarded while players are playing but in another location.

Additionally, when the jackpot is awarded, players don't see reasons to keep playing and devices stay relatively unused until the jackpot reached again an interesting value. Consequently, managers see their revenues decrease for this period.

Another method widely used by casino managers to attract players consists of awarding points transferable to services offered by the casino. To acquire points, players must possess a VIP card on which points will be credited in regards to their plays. The number of points varies in regards to different characteristics of the plays: the amounts played, the games played, the moment played, etc. Nevertheless, to acquire an interesting number of points, players must play a lot of money. Consequently, it does not succeed in interesting players who do not want to bet too much during their time at the casino.

Another strategy to keep players playing longer used by game designers is to create new games continuously presenting more innovative new bonuses, more high-quality graphics, more animations, more sounds, etc. Therefore, these features are there to create an atmosphere, a unique and interesting game environment. But, as interesting as these features are, they require time and money to develop. Furthermore, they require more and more powerful gaming devices to play them. Moreover, when players have seen all the possible bonuses in the game, they frequently lose interest for the game. Consequently, game designers needs to continually develop new games presenting new bonuses, new graphics, new animations, . . .

A different method used to attract players is to offer to place side bets on other options of their favorite game. An example of that consists of offering to players to place a side bet on the number of consecutive wins they can attain in a blackjack game. With this method, the game is not changed. Moreover, this is not an additional attraction to the game.

Nevertheless, some players see in the side bet other additional prizes and therefore new interest for the game. However, by adding additional bets, the strategies and rules of the game are slightly changed. Therefore, it can frustrate some players. This interest is not linked to a whole new environment of play; it does not create a new atmosphere of play.

Another possible way to play is on live tables, such as Poker, Blackjack, or Craps games. These games have the advantage of offering a social aspect. Players sit together at a table. When a player wins, other players have the possibility to congratulate him, to envy him, and therefore to take part of his success. However, the disadvantages of these games played in common are that players can not play at their rhythm. Moreover, it is difficult to keep the anonymous aspect of the game. The others players see you win or lose. Therefore, some players prefer electronic gaming devices for their liberty of play and the anonymous aspect of the play. Nevertheless, it does not involve that these players do not want some social aspect in the game.

Some players who want challenge take part of competition. In these competitions, the players compete simultaneously one against each other, and against themselves. During the competition, players plays on an electronic gaming device trying to gather the maximum number of points within a limited time. Therefore, players can try to win over their best score. Nevertheless, they also want to be one of the best players to reach the additional level of the competition. It allows them to compare themselves.

During the last decade, the electronic gaming devices that was designed to control the payout in regards to sequences of play, particularly designed in regards to controlling the money inserted in the machine and awarded by the machine, were retired. The governments judge them unfair for players. Nevertheless, some players regret these games and these devices. With these devices, they had criteria they used to determine if the machine was in a period of giving money to players, or increasing the incomes. Since, some players have tried to find new games offering this sense of control, therefore allowing them to loose less money, moreover to win some.

What players really want it a sense of control over the game. Additionally, they want to win big prizes. Players want these games to concurrently take a greater social aspect along to keeping players anonymous. To do so, they need a method of playing gambling games offering them to take part concurrently to influence the wins of others. Furthermore, they want to feel the influence of other players, therefore the social aspect of the game. To do so, the method of play must offer chances of wins in regards to the method of play to everyone relatively frequently. Therefore, the social aspect of the game become not a vague aspect of the game but a reality shared with all players.

Since none of the methods described above offer a social aspect to players regarding the game, nor a sense of control over the game, the invention offers a method of playing wagering games improving the pleasure players feel when playing the game, and consequently keeping them playing longer. More precisely, the method of play is applied on electronic gaming devices offering players all the freedom of play in addition to the anonymity they want. Furthermore, the method can be implemented on players' favorite games without changing the rules of the game. The method of play allows to award interesting prizes without awarding these prizes as rarely as progressive jackpots do.

SUMMARY OF THE INVENTION

Accordingly, it is an object of the present invention to provide a method of choosing and distributing enhanced odds, more precisely odds of greater value than regular odds in regards to particular winning combinations in the game.

Another object is to offer a method of playing a game offering a social aspect shareable by many players at a time.

Another object is to increase the suspense of the game by offering players to win new prizes having interesting values.

An additional object is to offer a new unpredictable aspect to the game that will keep players on the edge of their chair during the time they will play the game.

Therefore, the final object of the invention resulting of the other objects above is to offer to players a game offering them more pleasure, consequently keeping them playing longer than regular games.

According to the above objects, the invention is a method of choosing and distributing sets of enhanced odds. This method consists in its preferred embodiment of: 1) linking numerous electronic gaming devices, such as electronic Poker machines, on a network, 2) gathering a percentage of all the bets played on the electronic gaming devices such as progressive jackpots, 3) using a process depending basically on randomness to distribute for at least one play to at least one electronic gaming device a set of enhanced odds, and 4) using the amount gathered to pay prizes awarded with these sets of enhanced odds to consequently have no influence on the payout of the game.

This method has been developed for a local area network linking numerous electronic gaming devices in different gaming areas such as casino floors and bingo halls. When a predetermined criterion corresponding at a minimum available value of the enhanced odds account according to the kept percentage of the bets played on the electronic gaming device is attained, one device is selected with a random process to offer an enhanced play, i.e. a play offering a set of enhanced odds. Afterwards, further to the player placing their bets on the selected device, the electronic gaming device displays the enhanced odds to inform the player of an enhanced play, therefore increasing the suspense regarding the game.

In the following enhanced play, if the player yields a winning combination regarding one of the enhanced odds, the prize is paid in part from the regular odds of the game and in part by the value of available enhanced odds account, therefore the distribution of sets of enhanced odds do not influence the payout of the game.

After the play of an enhanced play on a selected electronic gaming device, if the value of the available enhanced odds account still attains or overshoots the criterion, a new electronic gaming device is selected by a random process to offer a new enhanced play.

Others criterions influencing the distribution of sets of enhanced odds can be determined like a minimum period, randomly determined period, or a randomly determined number of plays between two selections of devices, multiple sequential enhanced plays on one electronic gaming device, distribution of a set of enhanced odds from a bank of predetermined sets of enhanced odds, wherein the distributed set of enhanced odds is randomly chosen in regards to criterions, etc.

These and other features, aspects and advantages of the present invention will become better understood with regard to the following description and accompanying drawings, wherein:

DETAILED DESCRIPTION OF THE PREFERRED EMBODIMENTS

Figure 1:
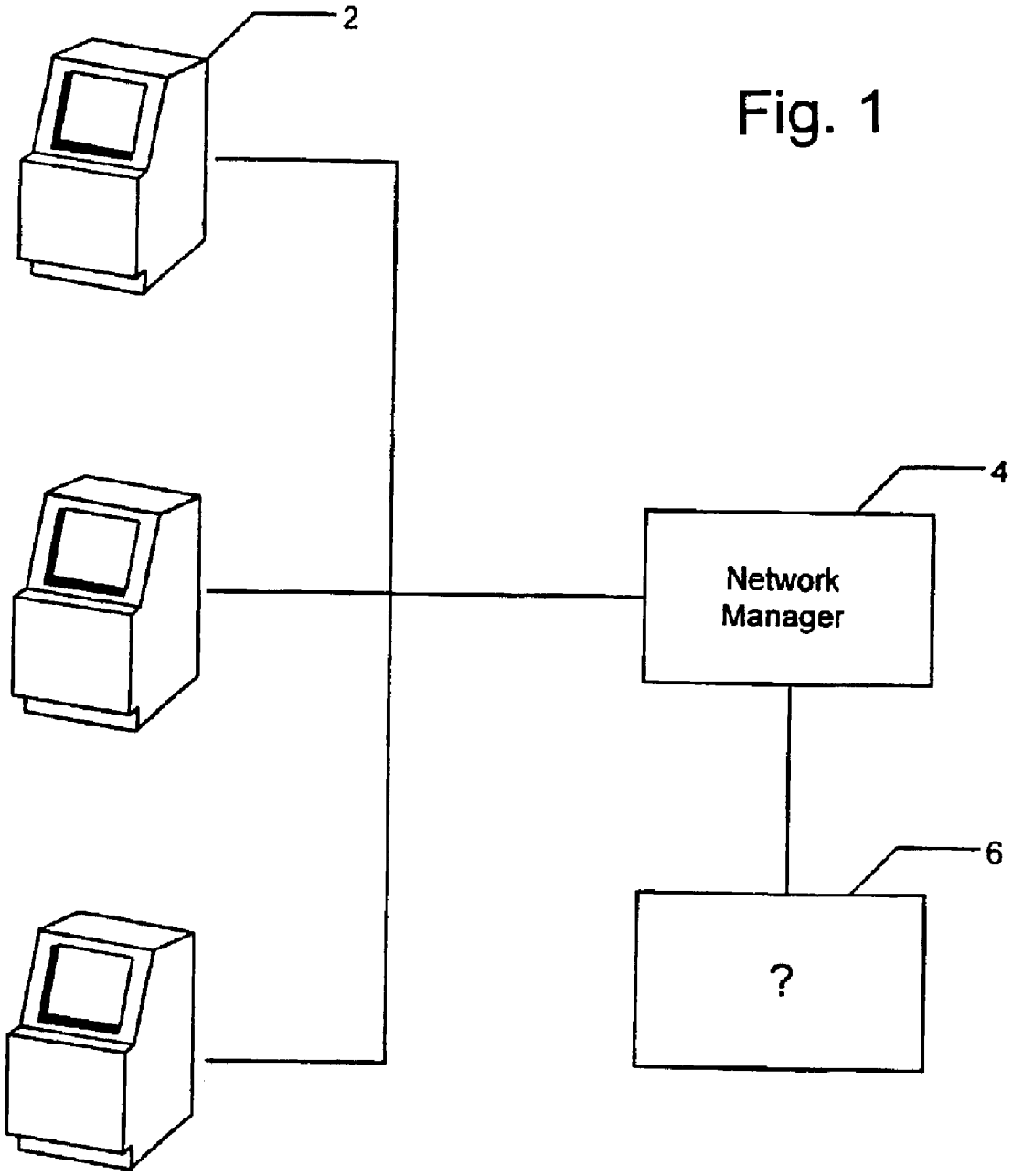
FIG. 1 is a schematic representation of an environment of play comprising numerous electronic gaming devices for the method of choosing and distributing enhanced odds.

The gaming environment offering a preferred embodiment constructed in accordance with the method of the present invention is schematically shown on the FIG. 1. It consists to a network linking numerous electronic gaming devices 2. Furthermore, a network manager 4 controls the information on the network. The network also comprises most of the time other devices 6 such as jackpot displays, players tracking devices, clerk system managers, etc. For exemplary purpose, the game played on these electronic gaming devices 2 is a Poker game.

A part of the tasks of the network manager is, like with progressive jackpots, to gather information from the electronic gaming devices regarding their plays. More precisely, the network manager gathers information regarding the plays and bets in the game implemented with the method of distributing enhanced odds. Furthermore, the network manager accumulates a predetermined percentage of the bets in an available enhanced odds account.

When the value of the available enhanced odds account reaches a predetermined amount, the network manager is ready to distribute a set of enhanced odds for one play to one electronic gaming device. The preferred way to distribute a set of enhanced odds, i.e. an enhanced play, is to choose by a random process one of the electronic gaming devices actually playing the game while choosing the device. Afterwards, the network manager sends to the selected electronic gaming device the information regarding the enhanced play (i.e. flag data for identifying the enhanced odds). At this moment, the regular odds of the game are replaced by the enhanced odds. More precisely, the only odds replaced are the one being changed. In the preferred way, only the higher winning combinations have enhanced odds, the others stays unchanged in regards to the odds of a regular Poker game. Thus any desired winning combination or other game event may be selected to enjoy enhanced odds (or an enhanced payout) as determined by the flag data.

When a player sees the electronic gaming apparatus he plays on presenting enhanced odds, the lucky player has a chance of playing a potentially more interesting play than the previous ones. Nevertheless, it is unsure that the game will pay. Contrarily to second screen bonuses present in other games, it depends on the outcomes yield by the player during the play. If the player does not yield any winning combination, there is no difference from a regular play. If the player yields a winning combination that has not enhanced odds, there is also no difference from a regular play.

However, if the player succeeds to yield a winning combination having enhanced odds, the player is awarded an enhanced prize.

Then, when the play is played to its final outcome, the odds in the game return to their primary value. Therefore, the following plays return to the original features and values.

Afterwards, depending on the value of the available enhanced odds account. More precisely, depending if the value of the available enhanced odds account still attains the criterion, the network manager chooses another electronic gaming device to distribute a set of enhanced odds. However, usually, the network manager waits a variable period of time or number of plays before choosing a new electronic gaming device, therefore, rendering the distribution of enhanced odds less predictable.

Moreover, an additional feature is to choose the set of enhanced odds distributed form a bank of different sets. Accordingly, the distribution of enhanced plays is even less predictable, resulting in increasing the suspense regarding enhanced plays. Furthermore, a way of determining the sets of enhanced odds is to enhance the winning outcomes in regards to common objects in regards to these outcomes. Outcomes associated with a common strategy of play can be enhanced together, therefore driving the strategy used by players during these enhanced plays. However, depending on the enhanced plays received from time to time, the optimal strategy of play will change.

To increase even more the social aspect of the method, a modification of the electronic gaming devices is proposed. This modification has object to inform surrounding players of devices being distributed enhanced plays of the enhanced play. The modification consists to add or use a system actually present on the electronic gaming device to inform surrounding players that enhanced plays are distributed. This system can consists to highlighting a light sign on top of the electronic gaming device when an enhanced play begins. This way, surrounding players have the possibility to take part of the thrill of the lucky player. Moreover, by informing surrounding players of the distribution of enhanced plays, they see that the distribution of enhanced odds is a feature frequently distributed, and therefore a feature they can hit times to times.

Furthermore, the selection of electronic gaming devices is made the way further described. Criteria in regards to the available enhanced odds account and the environment of play are evaluated. In the case of the criteria successfully evaluated on the network, a random selection process is used to select one device from all the electronic gaming devices on the network. On all the unselected devices are played regular plays; therefore plays that do not differ from the usual. However, on the selected device, a display shown on the screen of the. device informs the lucky player of the next play offering enhanced odds. Afterwards, the player plays the same game with the same rules, however with a set of enhanced odds rather than with the regular odds. At the end of the play, the final outcome is evaluated to award a prize if it corresponds to a winning combination. If the outcome is a winning combination, the prize won is calculated in regards to the set of enhanced odds. Afterwards, the prize won is displayed on the screen and credited to the player. The portion of the prize according to the enhanced odds alone is withdrawn from the available enhanced odds account. Then, the odds return to their regular values for the following plays, therefore displaying the regular odds. Afterwards, the player has the possibility to play a new play by placing a new bet without enhanced odds. In the case of a play yielding a losing outcome, the odds return to their regular values and a new play is available on the device, and so without awarding any prize to the player.

In the preferred embodiment, the best way to determine a delay between distributions of two enhanced plays is to leave a random number of plays in a range from 16 to 24 between each distribution of enhanced plays. With variable number of plays between distributions of enhanced plays, players see the distribution of enhanced plays less predictable. Furthermore, by considering numerous plays between two distributions of enhanced odds, it is possible that the same device receives enhanced odds without any other electronic gaming device receiving one within the lapse of time between the enhanced plays. It is also possible for an electronic gaming device to play two (2) enhanced plays without any regular play between them. This way, players do not see any reason of changing of electronic gaming device or to desert the one they are actually playing on after playing an enhanced play. Statistically, there are no more chances for the next enhanced play to be played on their actual device than on any other device offering the same game.

The preferred way to distribute enhanced plays is that the network manager distributes different sets of enhanced odds. More precisely, in this example of a Poker game, one of the predetermined sets of enhanced odds is that only the four best Poker hands have enhancement in their odds. This choice permits to have better enhancement of the odds and less frequent withdraws from the available enhanced odds account. Therefore, it results to a more appealing game for players. Furthermore, it permits to distribute enhanced odds more frequently in regards to less frequent withdraw from the available enhanced odds account. Moreover, by placing only enhancements to odds of winning combinations having low probability to be yield, the suspense regarding the enhanced game is even more important. TABLE 1 following hereafter shows the normal odds and a first set of enhanced odds on an electronic gaming device for this example of a Poker game constructed with these characteristics.

TABLE 1

Example 1 of a set of enhanced odds for a Poker game

| Poker hand | Normal odds | Enhanced odds | Odds enhancements |
|---|---|---|---|
| Pair of Jacks or better | 1× | 1× | — |
| 2 pairs | 2× | 2× | — |
| 3 of a kind | 3× | 3× | — |
| Straight | 4× | 4× | — |
| Flush | 5× | 5× | — |
| Full house | 6× | 15× | 9× |
| 4 of a kind | 15× | 40× | 25× |
| Straight flush | 50× | 100× | 50× |
| Royal flush | 250× | 500× | 250× |

Nevertheless, to keep it less predictable and more appealing for players, the use of multiple sets of enhanced odds are appropriate. TABLE 2 shows a second set of enhanced odds suggesting to players particular winning combinations.

TABLE 2

Example 2 of a set of enhanced odds for a Poker game

| Poker hand | Normal odds | Enhanced odds | Odds enhancements |
|---|---|---|---|
| Pair of Jacks or better | 1× | 1× | — |
| 2 pairs | 2× | 2× | — |
| 3 of a kind | 3× | 3× | — |
| Straight | 4× | 8× | 4× |
| Flush | 5× | 5× | — |
| Full house | 6× | 6× | — |
| 4 of a kind | 15× | 15× | — |
| Straight flush | 50× | 100× | 50× |
| Royal flush | 250× | 500× | 250× |

Another criterion to look at for distribution of enhanced plays on electronic gaming device is to evaluate distribution in regards to the lapse of time between two (2) distributions of enhanced plays. This criterion has the advantage of offering more regularity in regards to distributions of enhanced plays in term of delay between them. Moreover, it avoids players to think that some periods of the day are good for plays offering enhanced odds and others periods are bad. In the case of a fixed predetermined number of plays between distributions of enhanced plays, the delay between two (2) distributions is directly related to the number of plays played per hour. Therefore, periods of low occupancy see longer delay between distributions. Consequently, some periods of the day are seen as bad periods in regards to enhanced plays. By avoiding too much regularity over number of plays between distributions of enhanced plays, operators will avoid bad periods in which the electronic gaming devices are deserted.

Figure 2:
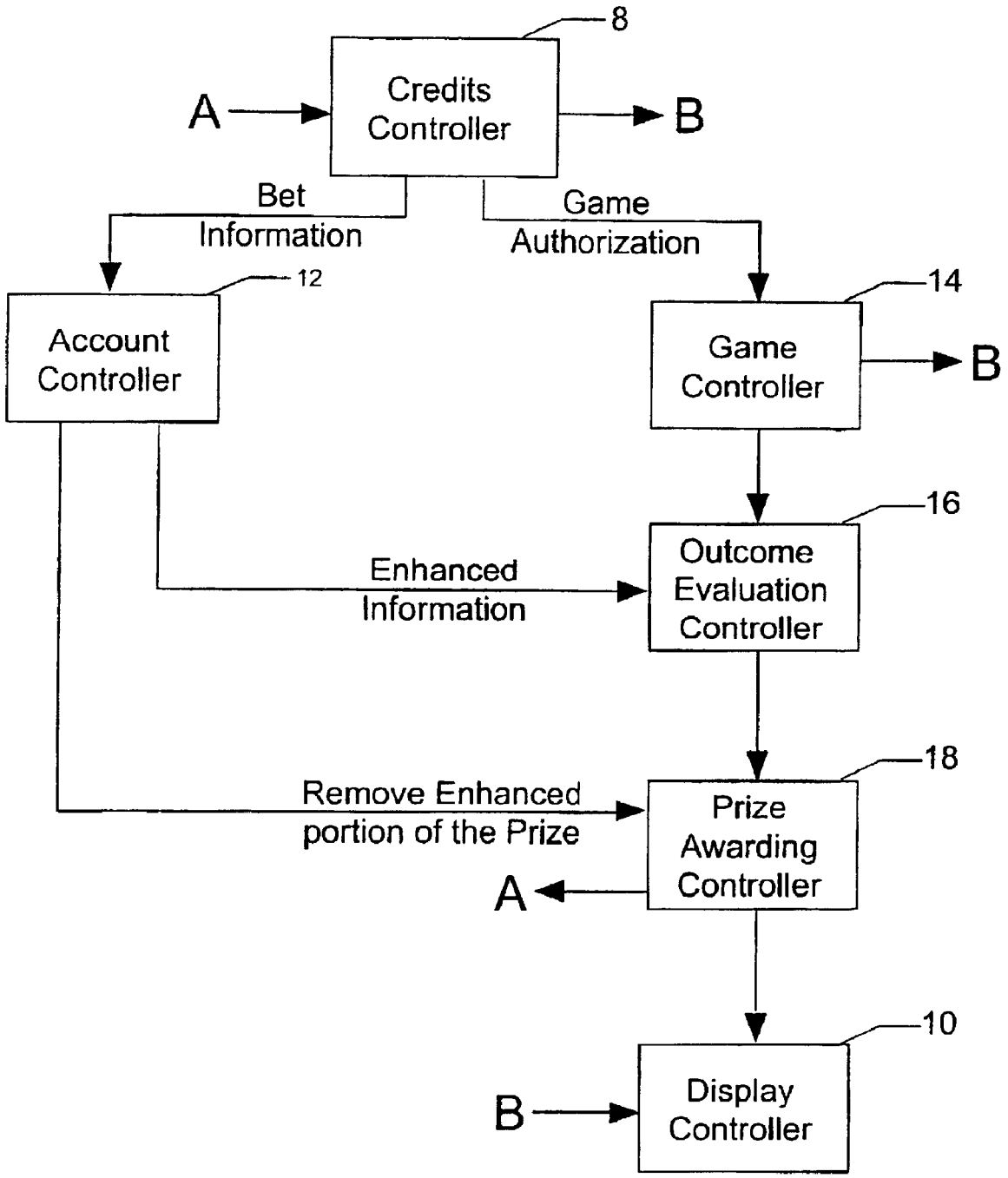
FIG. 2 is a block diagram according to the corresponding embodiment.

The block diagram of FIG. 2 shows the different processes each play of the game passes through. First, a credit controller 8 allows players to insert credits in the gaming device. The number of credits is continuously displayed 10 concurrently to the insertion of credits and the choice of a bet value by players. Afterwards, the information according to the bet is transmitted to the account controller 12, therefore increasing the account value along with a predetermined percentage of the bet. Simultaneously, a game authorization is sent to the game controller 14, therefore allowing the play to begin. The play is then played, displayed by the display controller 10 to the final outcome. Then, the final outcome is evaluated 16 in regards to a regular prize to award to the player. Following to the evaluation of the outcome 16, the prize is awarded 18 to the player by the credit controller 8 and also displayed 10 on the screen of the gaming device. However, before awarding the prize to the player, the outcome evaluation controller 16 receives from time to time information regarding enhanced odds from the account controller 12. When receiving information form the account controller 12, the value of some outcomes are enhanced. Afterwards, if a prize is awarded by the prize awarding controller 18, a portion of the enhanced prize is remove from the account by the account controller 12 to keep enhanced odds from influencing the regular payout of the game.

Figure 3:
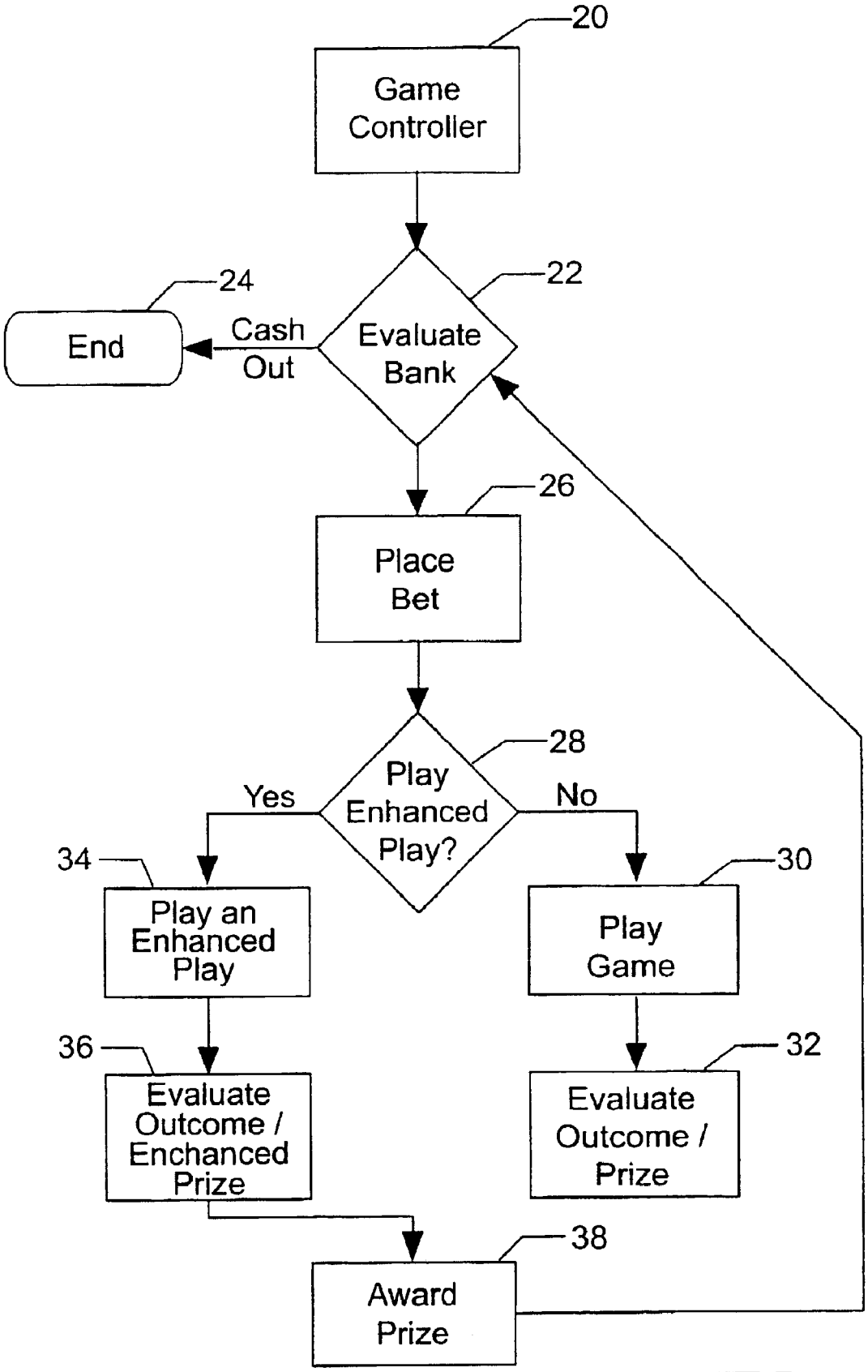
FIG. 3 is a flow chart according to the corresponding embodiment.

FIG. 3 is a flow chart presenting the steps of playing on an electronic gaming device using this method. These steps are relatively similar to ones on regular electronic Poker machines. First, a player inserts credits 20 in the gaming device for further use to bet on the game. Afterwards, depending if the number of credits in the device is enough for the bet 22, or if the player wants to, he adds new credits. At any time before placing the bet, the player can cash out the credits 24 from the device. Once the bet placed 26, the player sees or not appearing on the screen enhanced odds 28. If the player sees enhanced odds, the players knows that some outcomes have better value than usually. However, if the player does not see enhanced odds appearing on the screen of the gaming device, the player does not lose anything, it is still an interesting game. If there is no enhanced odds, the player plays a play of that game 30 to its final outcome. Afterwards, the outcomes is evaluated in regards to the prize to award 32 to the player. Then, the prize is awarded 38, credited in the bank of the player, who can play a new play. If there is enhanced odds, the player plays an enhanced play of that game 34 to its final outcome. Afterwards, the outcomes is evaluated in regards to the prize to award 36 to the player according to the enhanced odds. Then, the prize is awarded 38, credited in the bank of the player, who can play a new play.

All the features of the method steps described above expect the step of accumulating bets on the network and evaluating criteria in regards to distributing enhanced plays on a network of electronic gaming devices. However, the method can be implemented on a stand alone electronic gaming device.

For this embodiment, stand alone electronic gaming devices are installed in a common location. However, no network links them. Nevertheless, the devices can offer enhanced odds to players. Each of the electronic gaming devices is processed individually.

Furthermore, the same kind of criteria are use to determine the moment to offer enhanced plays on an electronic device. The difference resides in the fact that only the moment has to be determined, not the device. Afterwards, when the gaming device offer an enhanced play, the screen of the electronic gaming device displays the enhanced odds, the player plays his plays to the final outcome, and the prize is awarded to the player according to the outcome and the odds associated with the outcome in the enhanced play. Afterwards, depending if only one enhanced play has to be played, or many plays, the following plays presents enhanced odds or not. However, to avoid awarding amounts that are not in the available enhanced odds account, as soon as an enhanced prize is awarded, the next play is a regular play.

FIG. 2 presents in a block diagram for the above embodiment. First, a credit controller 8 allows players to insert credits in the gaming device. The number of credits is continuously displayed 10 concurrently to the insertion of credits and the choice of a bet value by players. Afterwards, the information according to the bet is transmitted to the local account controller 12, therefore increasing the account value along with a predetermined percentage of the bet of the gaming device. Simultaneously, a game authorization is sent to the game controller 14, therefore allowing the play to begin. The play is then played, displayed by the display controller 10 to the final outcome. Then, the final outcome is evaluated 16 in regards to a regular prize to award to the player. Following to the evaluation of the outcome 16, the prize is awarded 18 to the player by the credit controller 8 and also displayed 10 on the screen of the gaming device. However, before awarding the prize to the player, the outcome evaluation controller 16 receives from time to time information regarding enhanced odds from the account controller 12. When receiving information form the account controller 12, the value of some outcomes are enhanced. Afterwards, if a prize is awarded by the prize awarding controller 18, a portion of the enhanced prize is remove from the account by the account controller 12 to keep enhanced odds from influencing the regular payout of the game.

Figure 4:
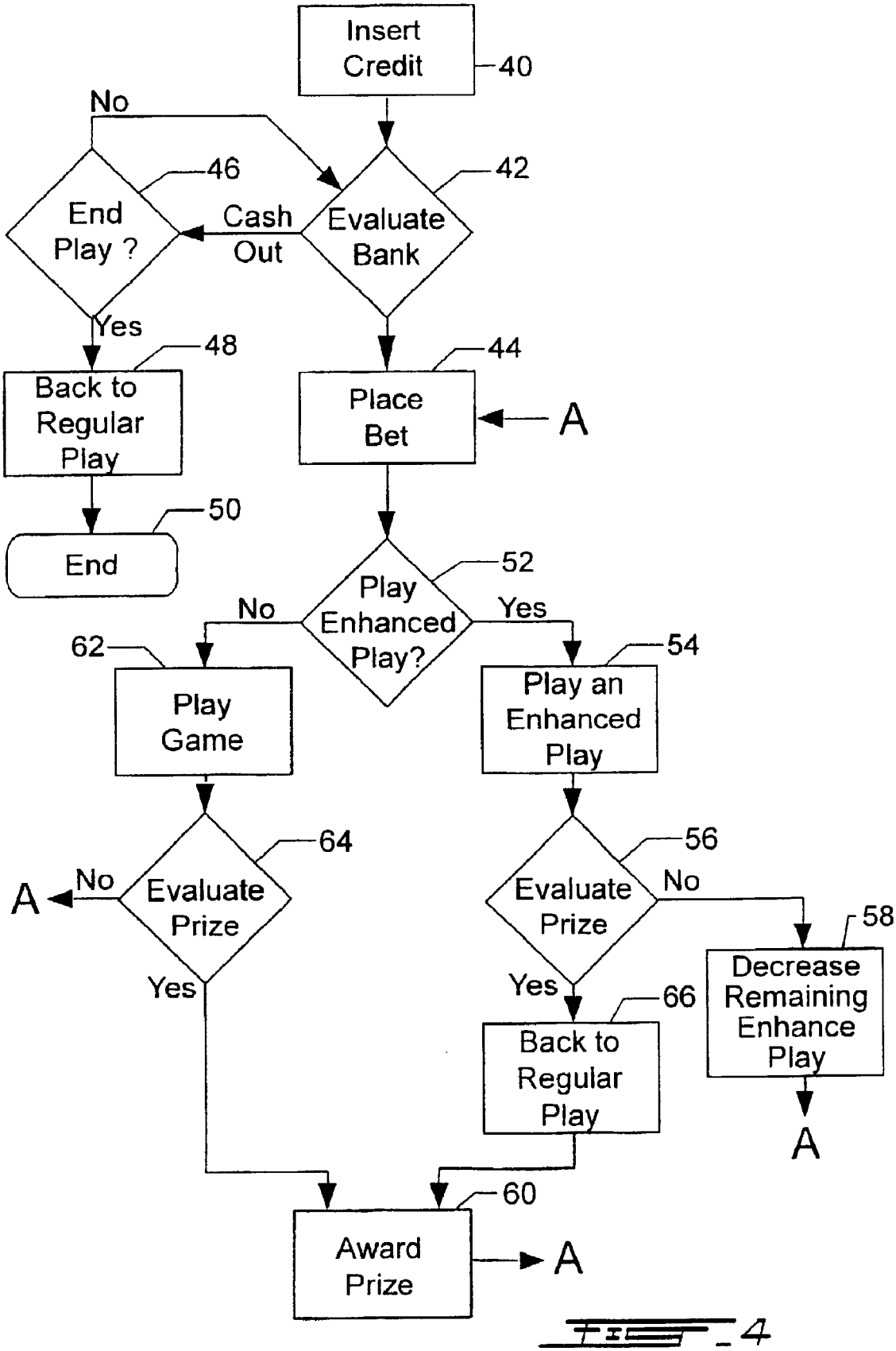
FIG. 4 is another flow chart for the present invention according to the corresponding embodiment.

Moreover, FIG. 4 presents the steps of playing on an electronic gaming device with the above embodiment. This steps comprises the verification of not allowing players to win enhanced prizes two plays straight. FIG. 4 illustrate with a flow chart the steps of playing on an electronic gaming device using this method. First, a player inserts credits 40 in the gaming device for further use to bet on the game. Afterwards, depending if the number of credits in the device is enough for the bet 42, or if the player wants to, he adds new credits. At any time before placing the bet, the player can cash out the credits 46 from the device, therefore returning automatically the odds to the regular odds 48 for a new player 50. Once the bet placed 44, the player sees or not appearing on the screen enhanced odds 52. If the player sees enhanced odds, the players knows that some outcomes have better value than usually. However, if the player does not see enhanced odds appearing on the screen of the gaming device, the player does not lose anything, it is still an interesting game. If there is no enhanced odds, the player plays a play of that game 62 to its final outcome. Afterwards, the outcomes is evaluated in regards to the prize to award 64 to the player. Then, the prize is awarded 60, credited in the bank of the player, who can play a new play. If there is enhanced odds, the player plays an enhanced play of that game 54 to its final outcome. Afterwards, the outcomes is evaluated in regards to the prize to award 56 to the player according to the enhanced odds. Then, the prize is awarded 60, credited in the bank of the player, who can play a new play. And if the prize awarded is an enhanced prize, the following play become automatically a regular play 66. However, if the player did not succeed to yield an outcome corresponding to an enhanced prize, the number of available enhanced plays decrease from one play 58.

Another embodiment consists of a network of electronic gaming devices playing the same Poker game. On the network, the network manager gathers information concerning the plays on the different electronic gaming devices. More precisely, the network manager accumulates a predetermined percentage of all the bets placed in the game on all the electronic gaming devices in one available enhanced odds account. Afterwards, depending on a random process of selection and on criteria similar to the ones utilized in the above embodiments, the network manager determines numerous electronic gaming devices to take part of a series of enhanced sprint plays. In this series of enhanced sprint plays, the available enhanced odds account is associated to one particular winning combination, therefore one highly enhanced odd. To win the amount corresponding to the value of available enhanced odds account, players must yield the particular winning combination determined above on their own electronic gaming device. The first to yield the winning combination is awarded a prize based on the value of the available enhanced odds account, the others nothing. Nevertheless, electronic gaming devices taking part of the series of enhanced sprint plays offer the possibility to win the same regular prizes that in regular plays. Therefore, players do not lose any advantages of the regular game by taking part of the series of enhanced sprint plays. At the contrary, by not participating to the enhanced sprint plays when thy have the possibility, they can miss interesting prizes.

To encourage players to yield fast the winning combination for winning the prize, the value of the available prize decreases in regards to the number of plays played by the whole group of electronic gaming devices taking part to the series of enhanced sprint plays from the beginning of the series to the moment the winning combination is yielded. Another way is to decrease the available prize in regards to the time between the beginning of the series of enhanced sprint plays and the moment the prize is won. Therefore, players see two (2) reasons to yield the winning combination as fast as possible: 1) to be the one winning the prize before anyone else yields the particular combination, and 2) to win it when the value of the prize is still interesting.

To increase the thrill in regards to the game, a proposition for this embodiment is to use a special light on top of the electronic gaming devices that are highlighted when the electronic gaming device takes part to a series of enhanced sprint plays. This way, players around them have the possibility to see that a competition is actually running and to encourage the players taking part to the competition. Moreover, players participating to the competition have the possibility to see each other and to render the competition personal. It creates a social atmosphere around this game hardly compared to any other game.

Figure 5:
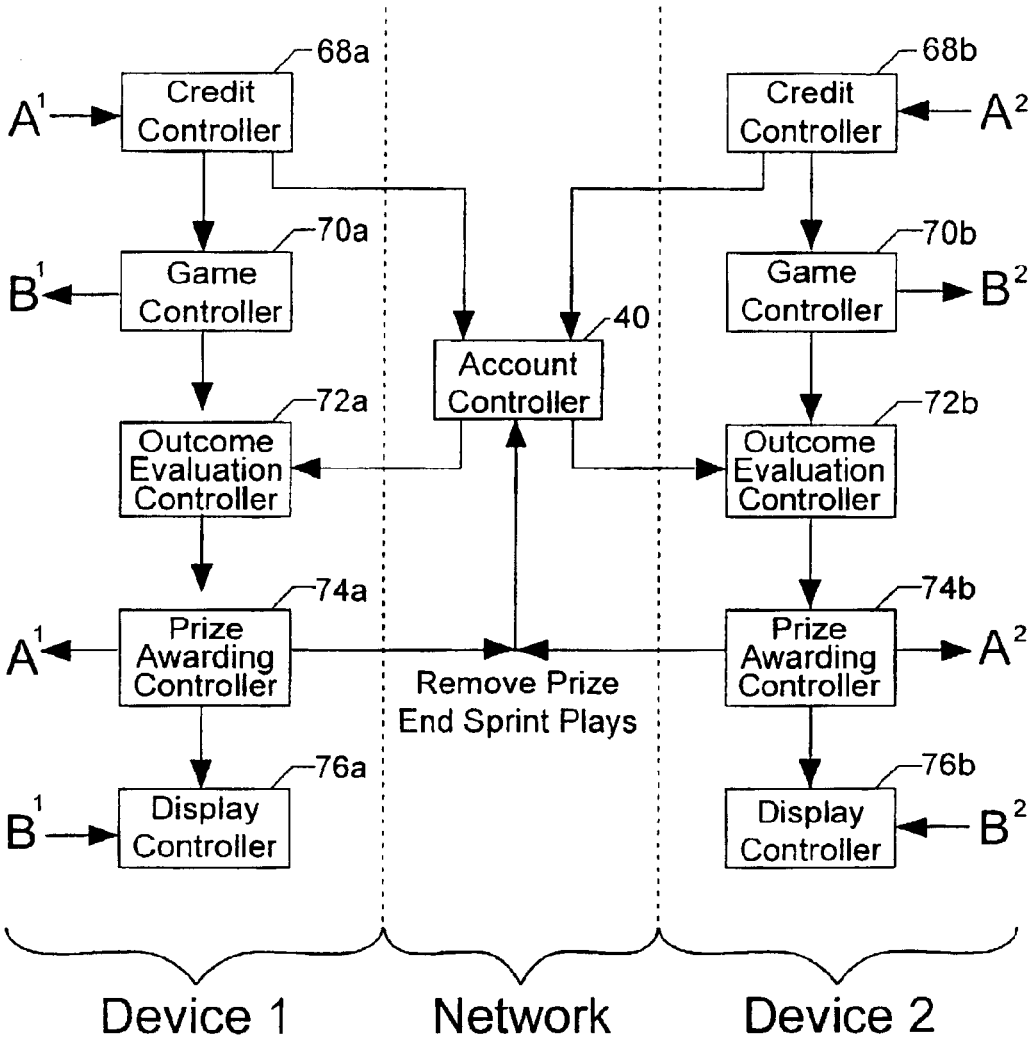
FIG. 5 is another block diagram according to the another corresponding embodiment presented below.

FIG. 5 presents a schematic representation with a block diagram of this third embodiment. For more clarity, the different controllers are divided in three categories: the ones of the device no.1, the ones of the network, and the ones of the device no.2. However, even if there are only two devices represented on the block diagram, it is understood that more than two can be present within the scope of this embodiment. Furthermore, for a bank of numerous electronic gaming device, depending of the moment it will not be always the same devices that will be represented in the block diagram by the devices no.1 and no.2.

According to the explanation above, the block diagram of FIG. 5 presents credit controller 68 for all the participating gaming devices. According to the bets placed in the gaming devices, a predetermined percentage of the bets are accumulated by the account controller 78 on the network. Once the bets placed, players can play 70 a play of the game on their respective gaming devices. Then, the outcomes are evaluated 72 in regards to award a prize 74 to the player. Afterwards, the value of the prize is displayed 76 on the screen the respective gaming device. However, sometimes, the account controller 78 selects a number of at least two gaming devices to participate to a series of enhanced sprint plays. When it appends, the account controller 78 transmits information to the selected gaming devices regarding the outcome awarding an enhanced prize. Therefore, players plays 70 regular plays on their gaming devices until one outcome evaluation controller 72*a* or 72*b* sees the particular outcome. Afterwards, the corresponding prize controller 74*a* or 74*b* award the enhanced prize according to the information received from the account controller 78. Then, the account controller 78 decreases the value of the account according to the part of the enhanced prize depending from the series of enhanced sprint plays.

Figure 6:
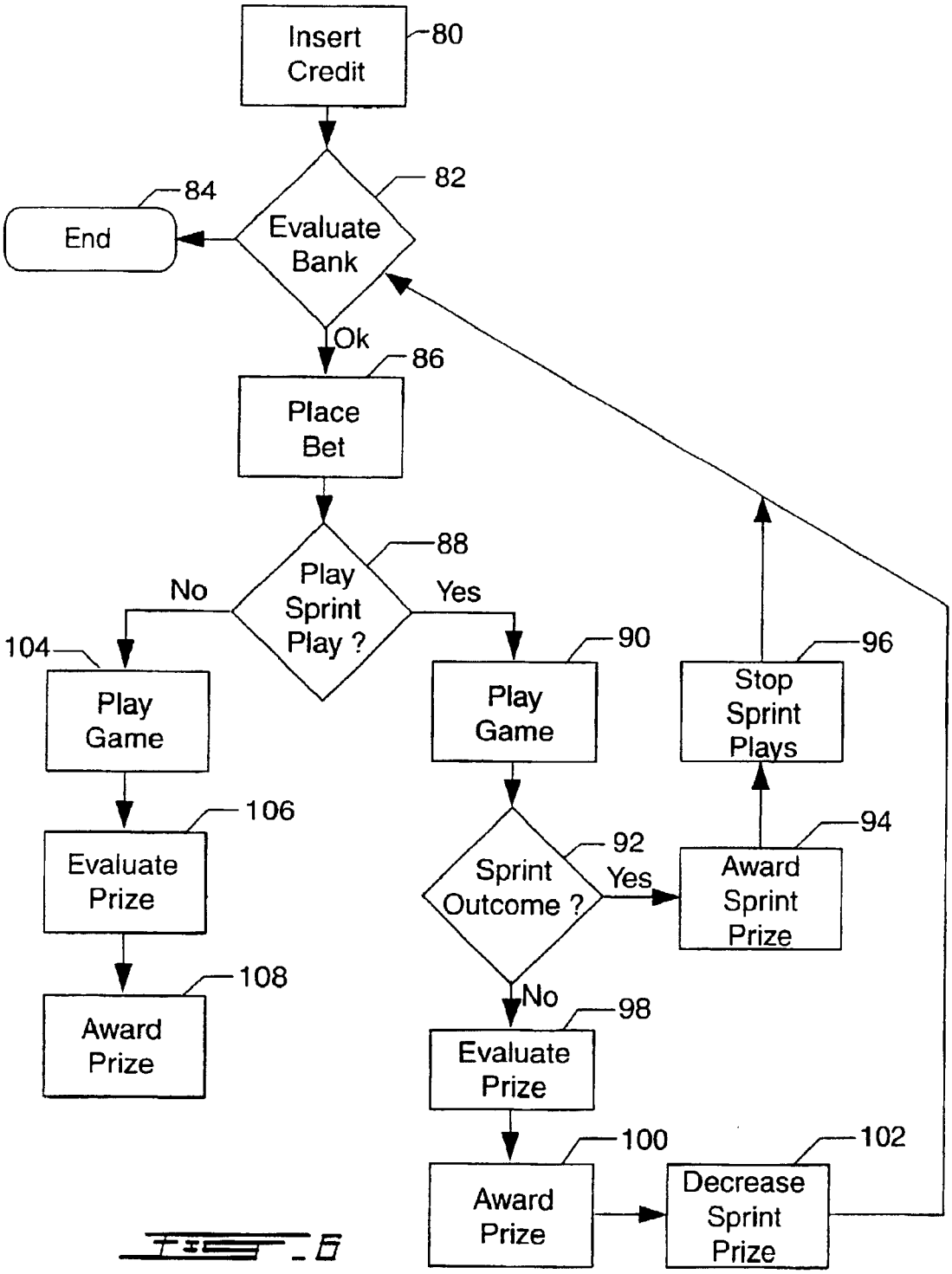
FIG. 6 is a flow chart according to the corresponding embodiment.

FIG. 6 presents in a flow chart the steps of playing according to the embodiment above. First, a player inserts credits 80 in the gaming device for further use to bet on the game. Afterwards, depending if the number of credits in the device is enough for the bet 82, or if the player wants to, he adds new credits. At any time before placing the bet, the player can cash out the credits 84 from the device. Once the bet placed 86, the player sees or not appearing on the screen a message informing him about an actual series of enhanced sprint plays 88. If the player participates to a series of enhanced sprint plays, the player knows that one outcome have better value than usually, furthermore a value that can be compared to a jackpot. However, if the player does not see any information concerning a series of enhanced spring plays appearing on the screen of the gaming device, the player does not lose anything, it is still an interesting game. If there is no series of enhanced sprint plays, the player plays a play of that game 104 to its final outcome. Afterwards, the outcomes is evaluated in regards to the prize to award 106 to the player. Then, the prize is awarded 108, credited in the bank of the player, who can play a new play. If there is a series of enhanced sprint plays, the player plays an enhanced play of that game 90 to its final outcome. Afterwards, the outcome is evaluated 92 first in regards to the particular outcome to yield in the series of sprint plays, then in regards to the prize to award 94 to the player. Then, if the outcome yielded is the particular outcome, a sprint prize is awarded 94 and the sprint plays are stopped 96 for the following plays on the actual device, and on all the devices participating to the series of enhanced sprint plays. If the outcome yielded is not the particular outcome according to the series of enhanced sprint plays, a regular prize is evaluated according to the outcome 98 and awarded 100, credited in the bank of the player, who can play a new play. Then, the value of the sprint prize is decreases 102 according to the criteria used to encourage players to yielded as fast as possible the particular outcome of the series of enhanced sprint plays. Afterwards, the player must place a new bet 86 to play a new play 90 or 104 according to the sprint prize being awarded or not.

Another embodiment consists of giving chances to win the value of the available enhanced account to multiple players concurrently like in the embodiment above. Furthermore, the embodiment consists of letting players gather points in a series of plays. The prize is awarded to the player who is determined in regards to the time, the number of plays used to gather the number of points needed, or to the player having gathered the most points during the series of plays. However, the preferred competition style embodiment is the one described previously. This embodiment is easier to play and to comprehend for players. Players do not need to play series of plays. They can win at their first play in the enhanced sprint plays.

A totally different embodiment consists to a random based game demanding no strategy from players. For this example, the game is a roulette game played on a network with numerous playing terminals disposed in different locations. In this embodiment, players place their bets on their own playing terminals. In a gambling location, a dealer places the ball on the roulette. The image of the roulette is transmitted to players simultaneously to the act on the gaming interface of their terminals. Furthermore, the bets are frozen on the players' terminals as soon as the ball placed by the dealer goes under a predetermined speed, therefore rendering impossible for players to add new bets. Afterwards, the final position of the ball on a particular area of the roulette decides the final outcome of the game. Depending of the bets of players, they win prizes or lose their bets. Moreover, if a player has placed numerous bets, he can concurrently win prizes and lose bets.

In a central control location, a network manager records the players' bets and accumulates in an available enhanced odds account a predetermined percentage of these bets. Sometimes, with a random selection process and in regards to criteria similar to the ones described in the embodiments above, one player sees appearing on the screen of his playing terminal a set of enhanced odds. This set of enhanced odds appears just before the moment when the dealer places the ball on the roulette, resulting of offering only a short delay to the lucky player for placing new bets in regards to the enhanced odds displayed on the terminal screen. Furthermore, it avoids the lucky player to place calculated new bets regarding these enhanced odds and his bets placed before the appearance of the enhanced odds. Afterwards, in regards to: 1) the final position of the ball on the roulette, 2) the bets placed by the player, 3) the regular odds of the play, and 4) the set of enhanced odds of the play, the player receives enhanced prizes or not. In the case of a player receiving enhanced prizes, the amounts of the prizes awarded to the player beyond the normal prizes are withdrawn from the available enhanced odds account.

Afterwards, if the value of the enhanced odds account still attains a predetermined value, a new playing terminal is randomly selected in regards to predetermined criteria to receive a set of enhanced odds. And so on without influencing the individual payoffs of the different playing terminals.

Figure 7:
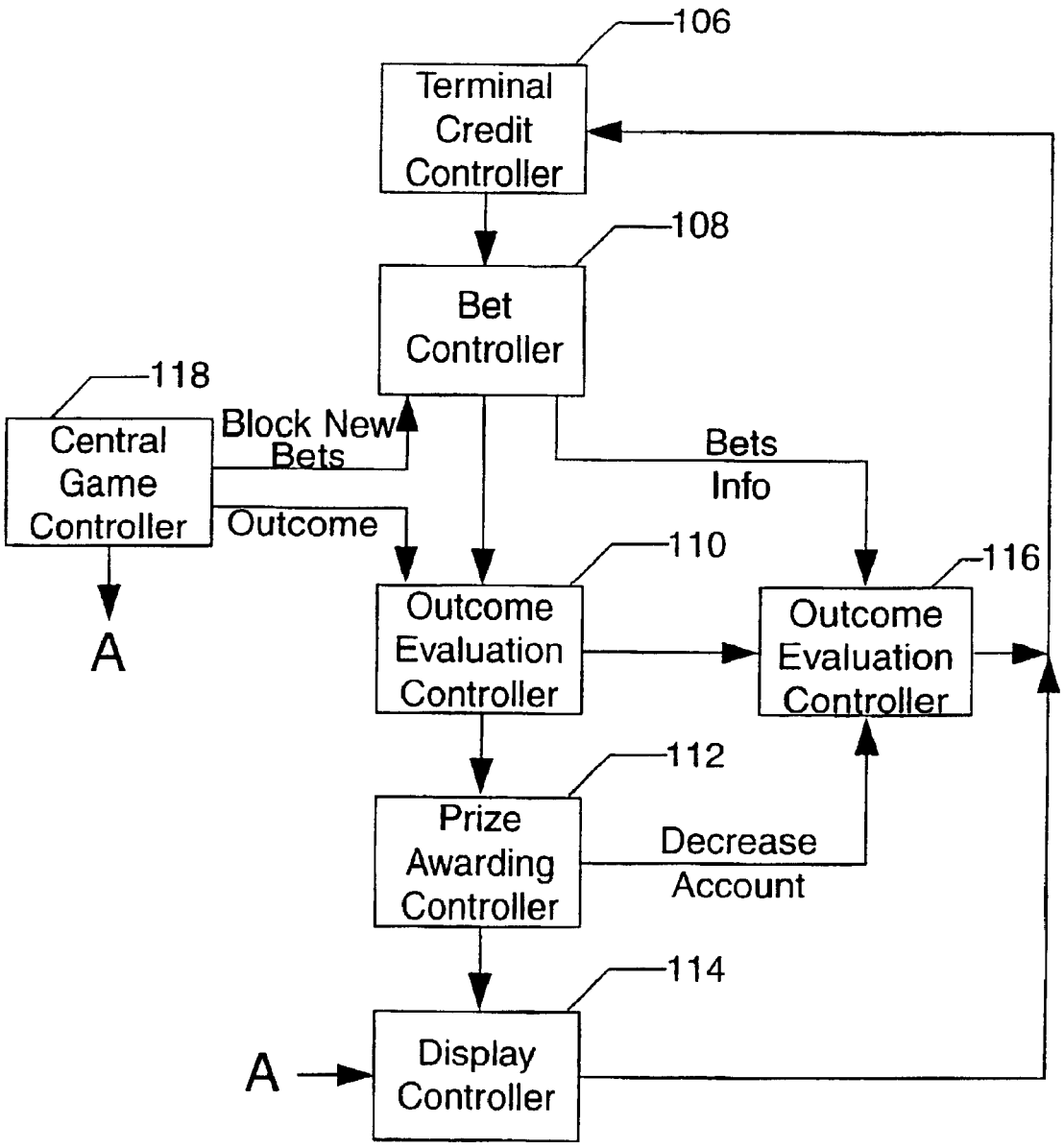
FIG. 7 is a block diagram according to the corresponding embodiment with a roulette game.

FIG. 7 illustrates with a block diagram this new embodiment. First, the terminal credit controller 106 receives the bets on each terminal. Afterwards, the bet controller 108 of each terminal records the bets placed by players. The bet controllers 108 also send information concerning the bets to an account controller 116. Then, the central game controller 118 plays the roulette game. When the ball in the roulette begins to be slower than a predetermined speed, the game controller 118 transmits information to all bet controller 108, resulting of freezing the bets and therefore blocking the possibility for players to place new bets. Afterwards, when the ball stops, the game controller 118 transmits the outcome to the outcome evaluation controller 110 of each terminal. Sometimes, in regards to the information contained in the account controller 116, the account controller 116 randomly selects a terminal to display 114 enhanced odds in a short delay before the game controller 118 transmits the order of freezing the bets. In the case of enhanced odds, after the final outcome of the game being determined, the outcome evaluation controller 110 determines the winning bets and the value of these winnings according to both regular odds that are not modified by the account controller 116 and the enhanced odds. Afterwards, the prizes are awarded 112 to the player and displayed 114 as the win value on the play screen of the gaming terminal. To inform at all time players of changes, the terminal credit controller 106, the bet controller 108 and the prize awarding controller transmit all changes of information to the display controller 114. However, the account controller 116 transmits information to the display controller 114 only concerning the changes of odds according to the enhanced odds.

A different embodiment here relates to gambling sites on the Internet. The embodiment consists to offering players a Blackjack game with a side bet possibility. This side bet is divided in two (2) different accounts common for all players; a progressive jackpot account and an enhanced odds account. Each of these two accounts takes a different percentage of the side bet such as the progressive jackpot account taking seventy-five percent (75%) and the enhanced odds account taking twenty-five percent (25%) of the side bets. By placing side bets, players are informed that they can obtain enhanced odds on some plays. As example, they can receive twenty (20) times the regular prize for a Blackjack when they are playing an enhanced play. If they succeed to yield a blackjack, the enhanced prize is credited to their personal account on the game site. However, the players are informed that they are playing an enhanced play only after placing their bets. Therefore, players cannot take advantage of the situation. Furthermore, it encourages them to place interesting bets in foresee of an enhanced play.

Furthermore, similar criteria as the ones described above are applied to determine which and when players are being offered enhanced odds. These criteria can be for this embodiment a random selection of the player, criteria based on play factors such as the player's bet history and other information related to the player's profile, etc. Another criterion not based on any random process is to give to players a set of enhanced odds each time they accumulate a predetermined amount of bets. Therefore, the last criterion encourages players to bet more.

Figure 8:
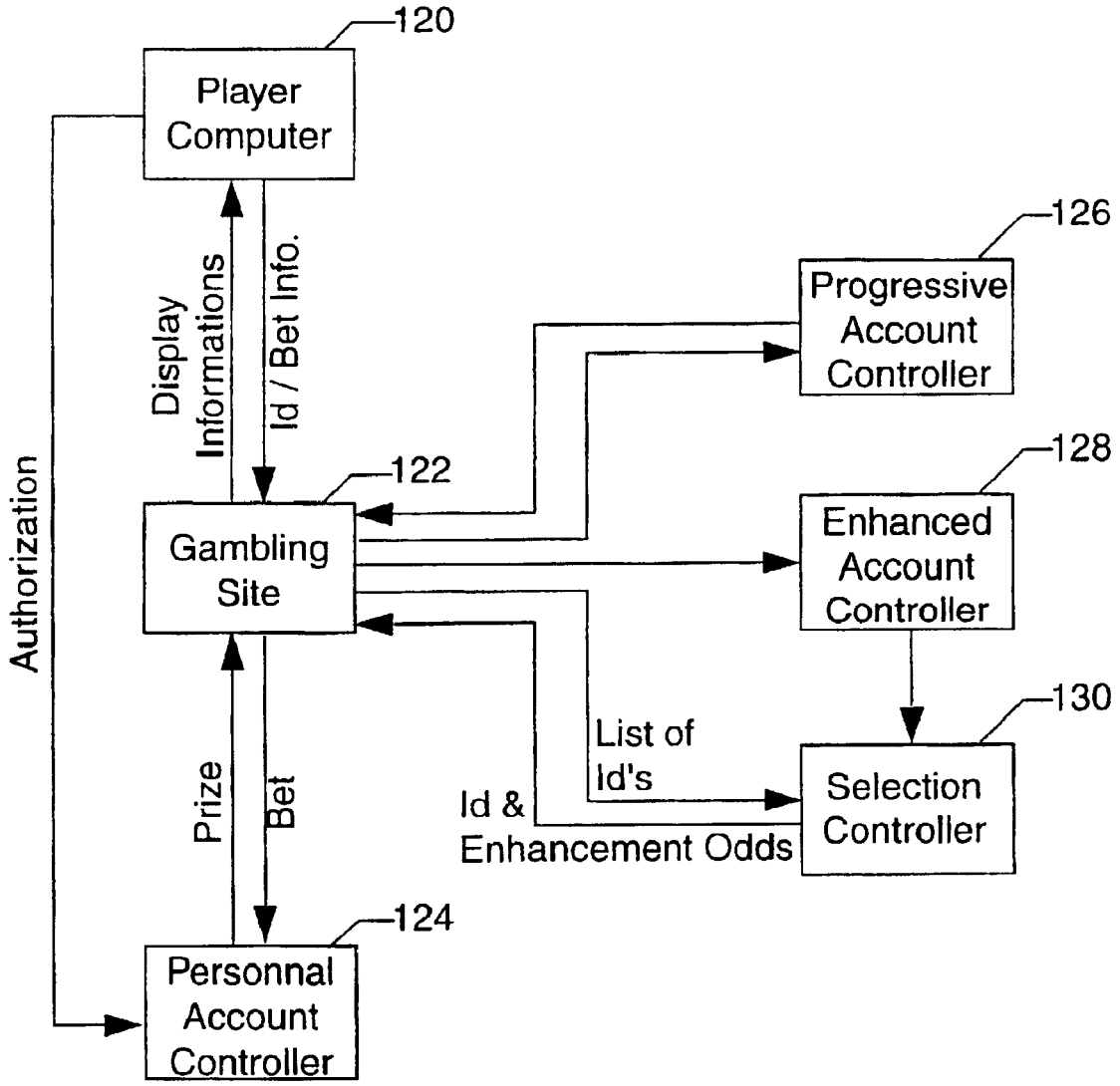
FIG. 8 is a block diagram according to the corresponding embodiment with an Internet based game.

FIG. 8 illustrate with a block diagram this particular embodiment. To play a game, players used their personal computers 120. Furthermore, to play, players communicate with their favorite Internet gambling site 122 offering the method of choosing and distributing enhanced odds. At the gambling site 122, they identify themselves and give an authorization by a personal authorization number or something else to their personal account controller 124 to give access to the account to the gambling site 122. Furthermore, it allows the gambling site 122 to remove the value of the player's bet from the account and to deposit player's prizes in the account. During the play, players place bets of two kinds, regular bets and side bets. The regular bet is used to play the game. The side bet is used in part to increase a progressive jackpot that can only be won be players who place side bets. Furthermore, the progressive jackpot is managed by a progressive jackpot controller 126. Another part of the side bet is managed by an enhanced odds account controller 128. This controller 128 increase the enhanced odds account with its part of the side bets placed at the gambling site 122 and decrease its value in regards to the enhanced prizes awarded by this same gambling site 122. However, to award enhanced prizes, the gambling site 122 must receive information from the selection controller 130 about the choice of the player receiving enhanced odds. This choice is transmitted via the identification of the player. Furthermore, with the identification information, the enhanced odds value is also transmitted to the gambling site.

To select a player, the selection controller 130 always keep tracks of the active players via a list of player codes, or player identifications transmitted by the gambling site 122. Therefore, the selection controller 130 can avoid selecting a player who is not actually playing on the gambling site 122. Furthermore, there is possibility for the gambling site 122 to transmit additional information concerning the players, therefore to select also in regards to the history of play of the players as an example.

The description of the above embodiments of the present invention has been presented for the purpose of illustration and is not intended to limit the invention. The scope of the present invention is defined by appended claims. Various modifications and changes may be applied without departing from the scope of the invention as set forth in appending claims.

What is claimed is:

1. A method of controlling a plurality of casino-gaming apparatus connected to a controller via a network, said method comprising:

receiving, at said controller, bet data from said plurality of casino-gaming apparatus to determine a network total of bets;

calculating, at said controller, an enhanced odd account value based on said network total;

analyzing, at said controller, said account value and determining whether an enhanced play should he offered;

signaling, from said controller, at least one of said plurality of casino-gaming apparatus to increase payout to offer said enhanced play, the enhanced play comprising a plurality of enhanced prizes with each enhanced prize being available to be won through the occurrence of a predetermined outcome;

receiving, at said controller, data on an enhanced prize awarded by said at least one signaled casino-gaming apparatus; and restoring a prize value corresponding to the awarded enhanced prize from an enhanced prize to a regular prize on at least the enhanced prize awarding casino-gaming apparatus after said signaled casino-gaming apparatus has awarded the enhanced prize, whereby a gradual restoration, one at a time, of the enhanced play prize values from an enhanced value to a regular value creates a longer enhanced play period.

2. The method of claim 1, comprising; signaling at least two casino-gaming apparatus to offer said enhanced play, monitoring outcomes occurring on said signaled casino-gaming apparatus and identically restoring the regular prize from an enhanced prize on said signaled casino-gaming apparatus after at least one of said signaled casino-gaming apparatus has awarded the enhanced prize.

3. The method of claim 1, wherein said enhanced odd account value is calculated as a percentage of said network total.

4. The method of claim 1, further comprising receiving data from said signaled casino-gaming apparatus on increased payout awarded by said signaled casino-gaming apparatus during the enhanced play, and prematurely ending said enhanced play on all of said signaled casino-gaming apparatus when said increased payout exhausts said account value.

5. The method of claim 1, further comprising receiving data from said signaled casino-gaming apparatus on increased payout awarded by said signaled casino-gaming apparatus during the enhanced play, and prematurely ending said enhanced play on all of said signaled casino-gaming apparatus when said increased payout decreases said account value under a predetermined value.

6. The method of claim 1, wherein said signaling comprises randomly selecting said at least one of said plurality of casino-gaming apparatus.

7. The method of claim 1, wherein players must place at least a predetermined bet to gain access to said enhanced play.

8. The method of claim 1, wherein players must place an additional bet to gain access to an additional prize during said enhanced play.

9. The method of claim 1, wherein a game played an said casino-gaming apparatus is a poker.

10. The method of claim 1, wherein a game played on said casino-gaming apparatus is a random-based game without player strategy required.

11. The method of claim 1, further comprising providing information to at least users of said signaled gaming apparatus on identity of said signaled gaming apparatus playing said enhanced play.

* * * * *